US011517162B2

(12) United States Patent
Kim et al.

(10) Patent No.: US 11,517,162 B2
(45) Date of Patent: Dec. 6, 2022

(54) REMAINING WATER SUCTION DEVICE HAVING AIR BLOWING FUNCTION

(71) Applicant: LG ELECTRONICS INC., Seoul (KR)

(72) Inventors: Jong Seok Kim, Seoul (KR); Daeyun Park, Seoul (KR); Inhyung Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 339 days.

(21) Appl. No.: 16/904,214

(22) Filed: Jun. 17, 2020

(65) Prior Publication Data

US 2020/0315417 A1 Oct. 8, 2020

Related U.S. Application Data

(62) Division of application No. 15/785,902, filed on Oct. 17, 2017, now abandoned.

(30) Foreign Application Priority Data

Oct. 18, 2016 (KR) ..... 10-2016-0134924

(51) Int. Cl.
*A47L 9/08* (2006.01)
*A47L 5/14* (2006.01)
*A47L 1/05* (2006.01)

(52) U.S. Cl.
CPC ..... *A47L 9/08* (2013.01); *A47L 1/05* (2013.01); *A47L 5/14* (2013.01)

(58) Field of Classification Search
CPC ..... A47L 1/05; A47L 5/14; A47L 9/08
See application file for complete search history.

(56) References Cited

U.S. PATENT DOCUMENTS 5,477,585 A * 12/1995 Hentzschel ..... A47L 5/14 15/345
5,599,401 A 2/1997 Brosky
5,943,732 A 8/1999 Bosyj
6,725,500 B2 4/2004 Allen
(Continued)

FOREIGN PATENT DOCUMENTS

CN 1123127 5/1996
CN 201524030 7/2010
CN 101909500 12/2010
CN 102772168 11/2012
(Continued)

OTHER PUBLICATIONS

EP-3097836-B1—English Machine Translation (Year: 2018).*
(Continued)

*Primary Examiner* — Marc Carlson
(74) *Attorney, Agent, or Firm* — Ked & Associates, LLP

(57) ABSTRACT

A remaining water suction device having an air blowing function according to the present disclosure includes a suction and blowing integrated nozzle, a suction motor unit for providing a suction force to suction remaining water into the suction and blowing integrated nozzle, a drain tank for storing a liquid from the suction and blowing integrated nozzle, an air blowing module for supplying pressurized air to the suction and blowing integrated nozzle, and a main body with the suction and blowing integrated nozzle, the suction motor unit, the drain tank and the air blowing module mounted therein.

6 Claims, 13 Drawing Sheets

(56) References Cited

U.S. PATENT DOCUMENTS

| | | | | |
|---|---|---|---|---|
| 6,735,813 | B2 * | 5/2004 | Oohama | A47L 5/14 15/327.5 |
| 9,326,651 | B2 | 5/2016 | Alshehri | |
| 2002/0108207 | A1 * | 8/2002 | Oohama | A47L 5/14 15/330 |
| 2006/0260089 | A1 | 11/2006 | Hammond | |
| 2007/0039123 | A1 * | 2/2007 | Bird | A47L 5/14 15/345 |
| 2013/0183141 | A1 * | 7/2013 | Tan | F01D 25/04 415/119 |
| 2014/0082882 | A1 | 3/2014 | Kawamata | |
| 2015/0208886 | A1 * | 7/2015 | Fischer | A47L 9/0626 15/353 |
| 2016/0128528 | A1 * | 5/2016 | Stewen | A47L 5/24 15/344 |
| 2018/0042436 | A1 * | 2/2018 | Wang | A47L 9/165 |
| 2018/0103813 | A1 * | 4/2018 | Kim | A47L 1/05 |
| 2018/0310786 | A1 * | 11/2018 | Zhong | A47L 5/26 |

FOREIGN PATENT DOCUMENTS

| | | | | |
|---|---|---|---|---|
| CN | 203042128 | | 7/2013 | |
| CN | 103948346 | | 7/2014 | |
| CN | 104619227 | | 5/2015 | |
| CN | 105496303 | | 4/2016 | |
| CN | 205514364 | | 8/2016 | |
| DE | 103 23 776 | | 12/2004 | |
| DE | 102012107994 | A1 * | 3/2014 | A47L 1/05 |
| EP | 0 988 822 | | 3/2000 | |
| EP | 3097836 | B1 * | 7/2018 | A47L 1/05 |
| WO | WO-2017044613 | A1 * | 3/2017 | A47L 5/14 |

OTHER PUBLICATIONS

Chinese Office Action (with English translation) dated Jul. 5, 2019 issued in CN Application No. 201710961453.4.

Chinese Office Action (with English translation) dated Feb. 12, 2020 issued in CN Application No. 201710961453.4.

* cited by examiner

REMAINING WATER SUCTION DEVICE HAVING AIR BLOWING FUNCTION

CROSS-REFERENCE TO RELATED APPLICATIONS

This application is a Divisional Application of U.S. application Ser. No. 15/785,902, filed on Oct. 17, 2017, which claims priority under 35 U.S.C. § 119 to Korean Patent Application No. 10-2016-0134924, filed on Oct. 18, 2016, whose entire disclosures are hereby incorporated by reference.

BACKGROUND

1. Field

The present disclosure relates to a remaining water suction device having an air blowing function for sucking and removing water remaining on the surface of a window or a wall, and more specifically, the present disclosure relates to a remaining water suction device that functions to suction and remove remaining water and to blow strongly jetted air.

2. Background

In cleaning a surface of a window or a wall of a building, detergents and a large amount of washing water may be used. If some of the washing water remains on the surface of the window and is not wiped off, then dust (or the like) may adhere to the remaining washing water, and thus, re-contamination may occur easily.

In addition, after cleaning a surface of a window or a wall, showering near the surface, or otherwise performing an activity that may cause water to be positioned on the surface, some water may remain on the surface. If the water remaining on the surface (hereinafter, referred to as "remaining water") is not removed, bacteria and/or mold may reproduce on the surface to cause unsanitary conditions.

Therefore, a remaining water suction device for removing the remaining water on a surface of a wall or a floor may be used. FIG. 1 is a view of a conventional remaining water suction device, and other arrangements may also be provided.

As shown in FIG. 1, a conventional remaining water suction device 10 may include a suction nozzle 12 having an suction port 12*a*, a water-air separation chamber 14 for separating water and air suctioned through the suction nozzle 12, a water tank 15 for storing the water separated in the water-air separation chamber 14, a suction fan 17 for providing a suction force to the water-air separation chamber 14, and a suction motor 16 for driving the suction fan 17.

Water may be suctioned through the suction port 12*a* using the suction force of the suction fan 17, and the suctioned water may be stored in the water tank 15. Further, the air, which may be suctioned together with the water through the suction port 12*a*, may be discharged through a discharge or exhaust port (not shown).

However, since the conventional remaining water suction device 10 may suction portions of the remaining water by applying a suction force at the suction port 12*a*, as described above, the conventional remaining water suction device 10 may be ineffective for removing other portions of the remaining water positioned away from the suction port 12*a*, such as remaining water on another surface. Furthermore, the conventional remaining water suction device 10 may be ineffective at removing remaining water that is scattered to be distributed over a large surface area.

In addition, since the conventional remaining water suction device 10 may only function to suction water, the conventional remaining water suction device 10 cannot cause a portion of the remaining water near a drain hole of the bathroom or the toilet to be moved to and discharged through the drain hole.

Furthermore, if some liquid flows into the suction motor 16 in the conventional remaining water suction device 10 (e.g., some of the suctioned water bypasses the water/air separation chamber 14), the suction motor 16 may be damaged. A separate absorption filter may be provided in the air flow path to the suction motor 16 to block water from reaching the suction motor 16, but the positioning of the absorption filter at this location may result in a decrease in the efficiency of the suction motor 16 and/or an increase in production costs.

BRIEF DESCRIPTION OF THE DRAWINGS

Embodiments will be described in detail with reference to the following drawings in which like reference numerals refer to like elements and wherein:

FIG. 4 and FIG. 5 are perspective views schematically showing a fluid flow guide body in the remaining water suction device shown in FIG. 3, wherein FIG. 4 is a front perspective view, and FIG. 5 is a rear perspective view;

DETAILED DESCRIPTION

Figure 1:
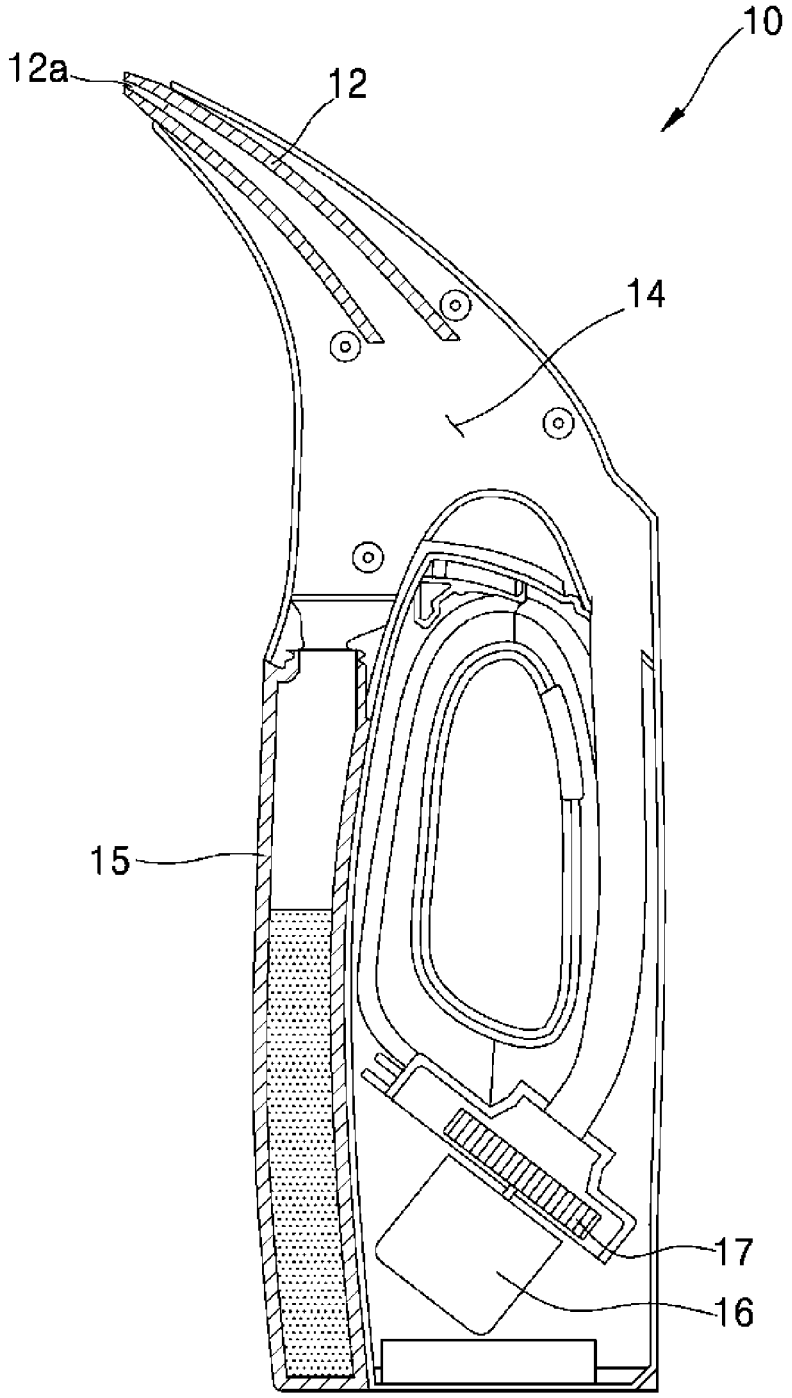
FIG. 1 Prior art
FIG. 1 is a schematic view illustrating a configuration of a conventional remaining water suction device.
Figure 2:
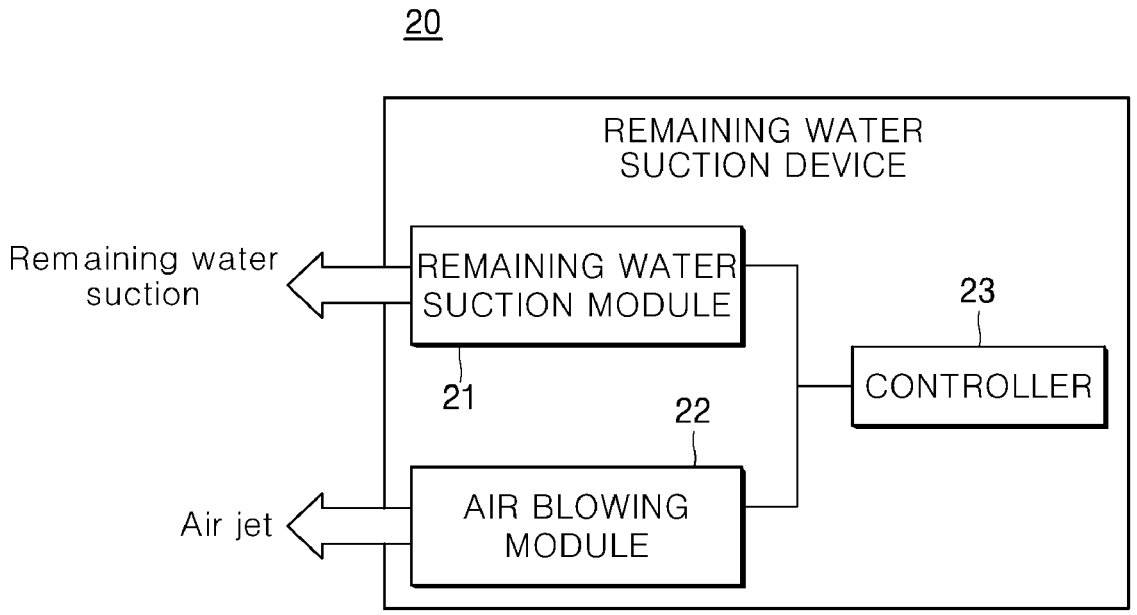
FIG. 2 is a schematic block diagram illustrating a remaining water suction device having an air blowing function according to aspects of the present disclosure.

FIG. 2 is a schematic block diagram illustrating a remaining water suction device 20 having an air blowing function according to the present disclosure. The remaining water suction device 20 may include both a remaining water suction function for suctioning remaining water and an air blowing function for moving the remaining water, and may selectively implement the remaining water suctioning function, the air blowing function, or a combination of the two functions. Other embodiments and configurations may also be provided.

The remaining water suction device (or water removal device) 20 may include a remaining water suction module 21, an air blowing module 22, and a controller 23. The user may select either the remaining water suctioning mode or the air blowing mode. The controller may selectively transmit a corresponding signal to the remaining water suction module 21 or the air blowing module 22 to implement, respectively, the remaining water suctioning function or the air jetting (or blowing) function. Hereinafter, a detailed configuration, an organic coupling, and an operating relationship of the remaining water suctioning mode and the air blowing mode in the remaining water suction device 20 according to the present disclosure will be described in more detail with reference to FIGS. 3 to 8.

Figure 3:
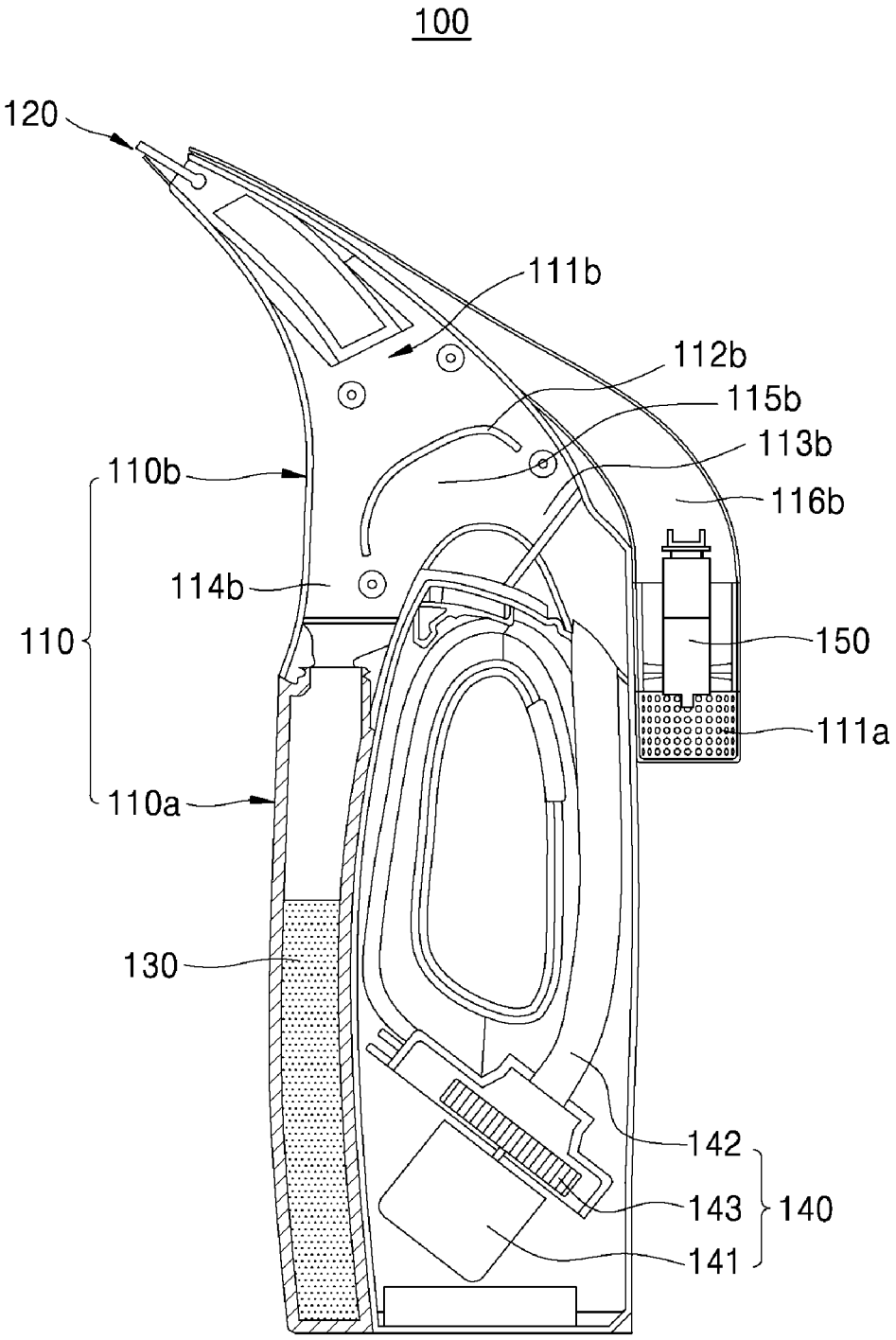
FIG. 3 is a schematic view illustrating a configuration of a remaining water suction device having an air blowing function according to a first embodiment of the present disclosure.

FIG. 3 is a schematic view illustrating a configuration of a remaining water suction device 100 having an air blowing function according to a first embodiment of the present disclosure. As shown in FIG. 3, the remaining water suction device 100 may include main bodies 110*a* and 110*b*, a suction and blowing integrated nozzle (also referred to herein as a "nozzle" 120, a drain tank 130, a suction motor unit 140, and an air blowing module 22 (see FIG. 2).

The air blowing module 22, which may serve to supply pressurized air to the suction and blowing integrated nozzle 120, may include a blowing motor 150 and a blowing duct portion (corresponding to a blowing duct 116*b* described later) for moving air blown by the blowing motor 150. The technical structure of the air blowing module 22 and the integration of the air blowing module 22 with the water suction function will be described later.

More specifically, the main body 110 may include a first main body 110*a* and a second main body 110*b*. A suction motor unit 140 and a blowing motor 150 may be installed in the first main body 110*a*, and the drain tank 130 may be detachably coupled to the first main body 110*a*. The second main body 110*b* may be implemented as a fluid flow guide body for guiding suctioned remaining water and blown air. The first main body 110*a* may be coupled to one end of the second main body 110*b*, and the suction and blowing integrated nozzle 120 may be mounted to the opposite end of the second main body 110*b*.

Figure 4:
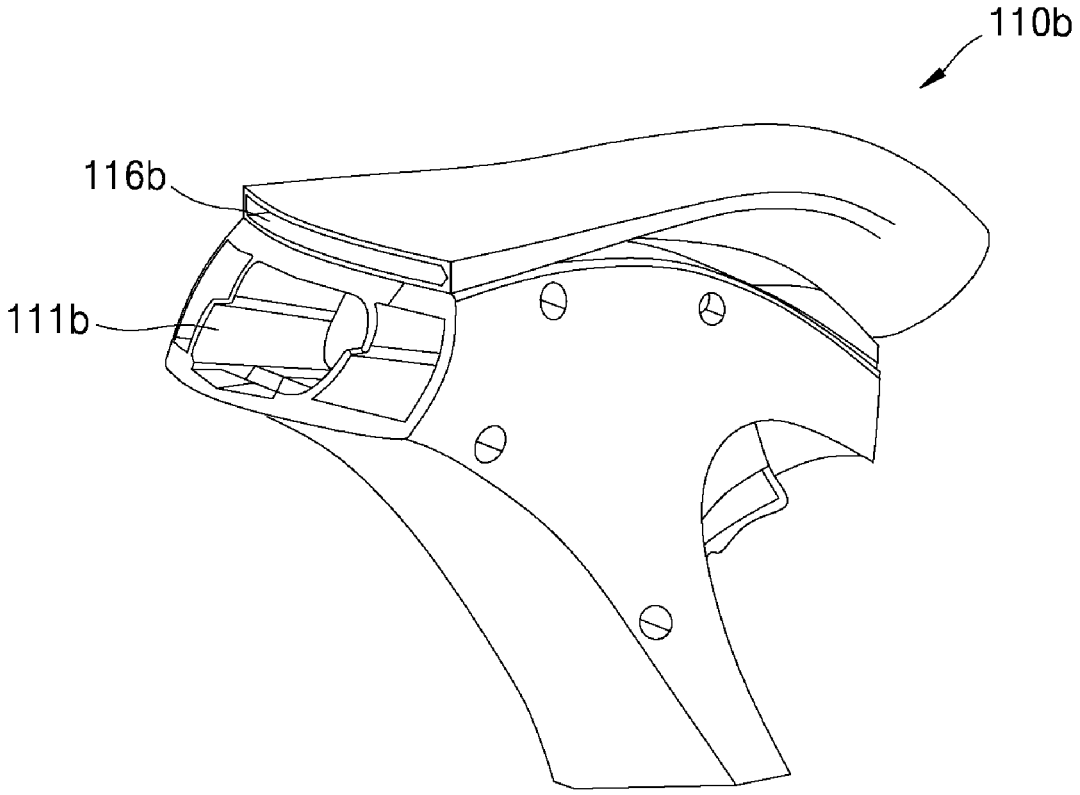
Figure 5:
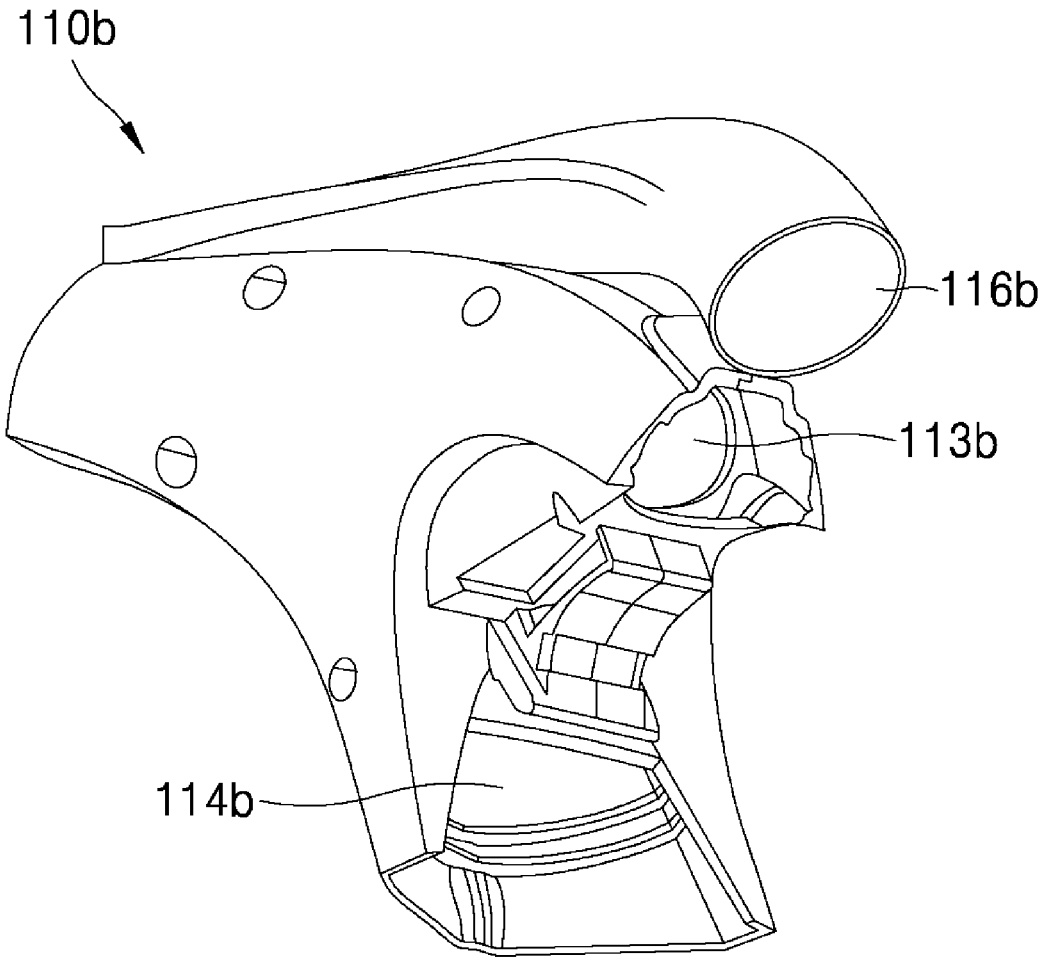

As shown in detail in FIGS. 3 and 4, the second main body 110*b* may include a suction portion (or suction chamber) 111*b*, a partition portion (or partition plate) 112*b*, an air discharge portion (or air discharge path) 113*b*, a liquid discharge portion (or liquid discharge path) 114*b*, an air flow chamber 115*b* and a blowing duct 116*b*. The suction portion 111*b* may be formed in the shape of a through-hole, and remaining water and air may be simultaneously introduced thereinto from the suction and blowing integrated nozzle 120.

The partition portion 112*b* may serve to move the remaining water introduced through the suction portion 111*b* to the liquid discharge portion 114*b*. To this end, the partition portion 112*b* may be formed to face the suction portion 111*b*, and may be provided to be inclined downward toward the liquid discharge portion 114*b*. Accordingly, the remaining water introduced through the suction portion 111*b* may first collides with the partition portion 112*b*, may then flow down the partition portion 112*b*, and may then flow to the liquid discharge portion 114*b*.

The liquid discharge portion 114*b* may be formed to face the drain tank 130 mounted on the first body 110*a*. Meanwhile, the air introduced through the suction portion 111*b* may be guided by the partition portion 112*b* and may flow to the air discharge portion 113*b*. The air discharge portion 113*b* may be formed to face the suction motor unit 140, which may be mounted on the first main body 110*a*.

The air flow chamber 115*b* may serve to cause the air flowing toward the liquid discharge portion 114*b* to flow to the air discharge portion 113*b*. The air flow chamber 115*b* may be positioned on the back of the partition portion 112*b* and may communicate with the air discharge portion 113*b*. Here, the suction portion 111*b* may be positioned in front of the partition portion 112*b*.

The blowing duct 116*b* may be a component of a blowing duct portion in one embodiment of the air blowing module 23. The blowing duct 116*b* may be formed to face the blowing motor 150, which may be mounted in the first body 110*a*. The blowing duct 116*b* may have a cross-sectional area which gradually decreases from one end thereof facing the blowing motor 150 to the opposite end such that the flow rate of the air blown by the blowing motor 150 may be increased when the air blown by the blowing motor 150 is jetted from the suction and blowing integrated nozzle 120. The air pressurized by the shape of the blowing duct 116*b* may be supplied to the suction and blowing integrated nozzle 120.

The main bodies 110*a* and 110*b* may be divided into the first main body 110*a* and the second main body 110*b* by the functions thereof. In one example, the first main body 110*a* and the second main body 110*b* may be integrally formed.

Figure 6:
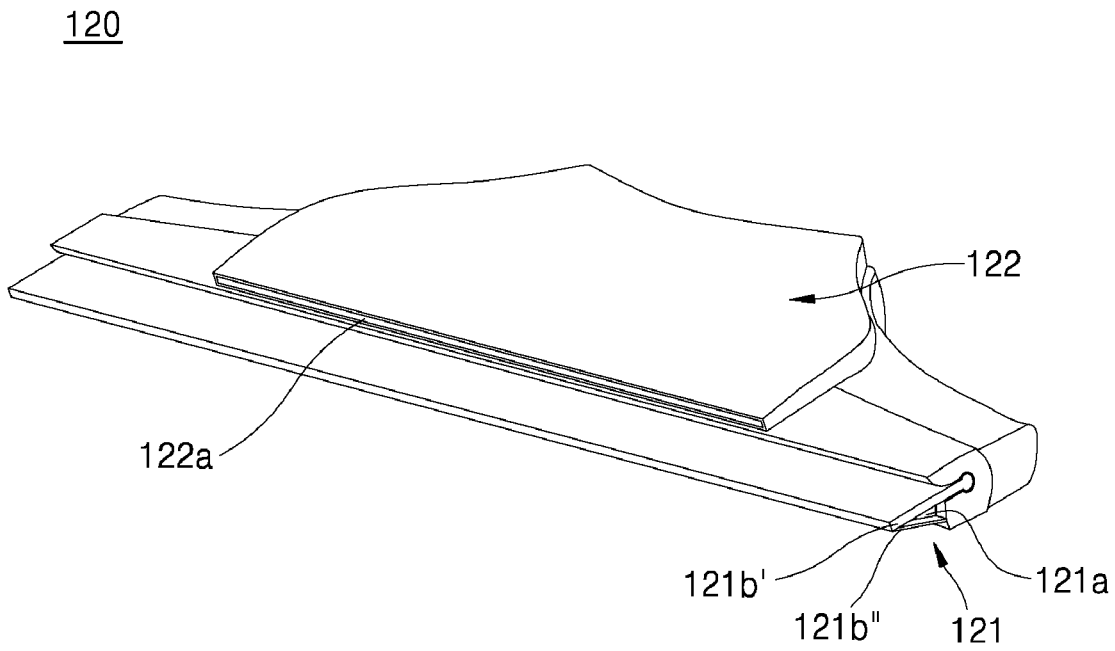
FIG. 6 is a perspective view schematically showing a suction and blowing integrated nozzle in the remaining water suction device shown in FIG. 3.

Next, as shown in detail in FIG. 6, the suction and blowing integrated nozzle 120 may be provided with a suction portion (or suction head) 121 and a blowing portion (or blowing head) 122 to simultaneously perform suction of remaining water and jetting of air. The suction portion 121, which serves to suction remaining water, may be provided with a penetrated portion (or suction port) 121*a* that may be penetrated from the outside of the main body 110 toward the suction portion 111*b* of the second main body 110*b*. The penetrated portion 121*a* may be formed as a substantially straight slit to improve suction efficiency by concentrating a suction air flow through the slit.

In addition, contact plate members (or contact blades) 121*b*' and 121*b*" may be mounted in or near the penetrated portion 121*a*. The contact plate members 121*b*' and 121*b*" may be provided to prevent damage to the suction portion 121 or the wall surface (or the floor surface) upon contact with the wall surface (or the floor surface) and may be formed, for example, of a deformable elastic material.

The blowing portion 122 may serve to discharge the pressurized air flowing from the blowing motor 150 to the outside. To this end, the blowing portion 122 may include a penetrated portion (or blowing port) 122*a* allowing the outside of the main body 110 to communicate (or provide an air flow path) with the blowing duct 116*b* of the second main body 110*b*. The penetrated portion 122*a* may be formed to have a cross-sectional area that is gradually reduced in cross section area between an exterior opening and the blowing duct 116*b* such that a nozzle is formed. For example, the cross-sectional area may be gradually reduced from the blowing duct 116*b* to the penetrated portion 122*a* such that the air blown by the blowing motor 150 may be rapidly jetted through the blowing portion 122 of the suction and blowing integrated nozzle.

In addition, any liquid suctioned through the suction and blowing integrated nozzle 120 may be stored in the drain tank 130. As shown in FIG. 3, the drain tank 130 may be positioned in the second main body 110*a*.

The suction motor unit 140 may include a suction motor 141, a suction duct 142, and a suction fan 143. One end of the suction duct 142 may be coupled to the suction motor 141, and a second, opposite end thereof may be connected to the air discharge portion 113*b* of the second main body 110*b*.

Further, the blowing motor 150 may be positioned to face the blowing duct 116*b* of the second main body 110*b*. For example, the blowing motor 150 may be implemented as a fan motor or other component to generate an outward air flow through the blowing duct 116*b*. A filter 111*a* may be mounted to the first main body 110*a*, in which the blowing motor 150 may be mounted. That is, the filter 111*a* may be mounted so as to face the blowing motor 150.

Figure 7:
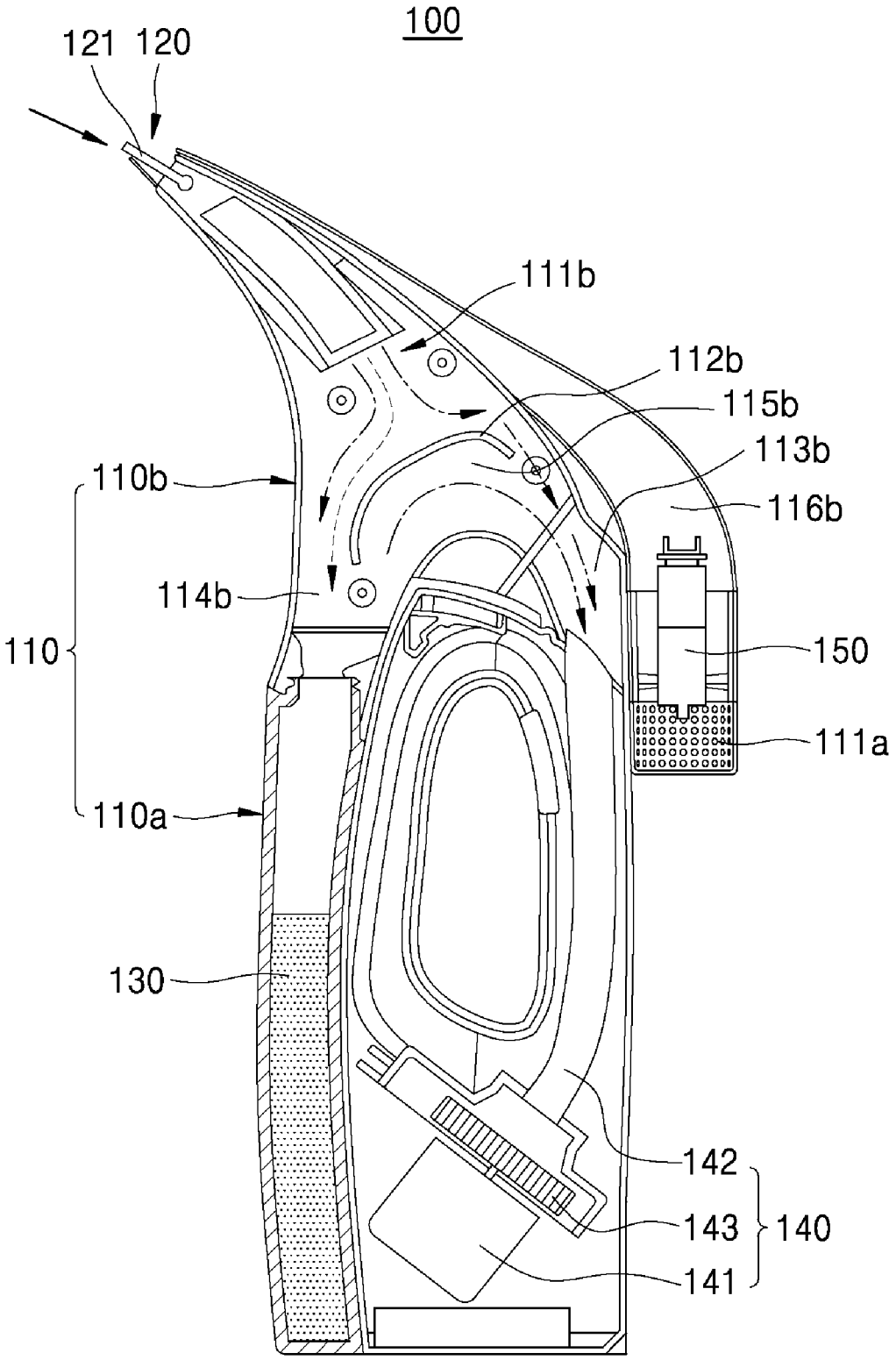
FIG. 7 is a schematic view illustrating operation in a remaining water absorption mode of the remaining water suction device shown in FIG. 3.

The remaining water suction device 100 having the air blowing function according to the first embodiment of the present disclosure may be constructed as described above with respect to FIGS. 3-6. Hereinafter, the remaining water suction and air blowing in the first implementation will be described in more detail with reference to FIGS. 7 and 8. FIG. 7 is a schematic view illustrating operation in a remaining water absorption mode of the remaining water suction device shown in FIG. 3.

When the user selects the remaining water absorption mode to suck in water, the suction motor 141 may be operated to drive the suction fan 143 to generate a suction force. The suction force may cause remaining water and air to be introduced into the suction portion 121 of the suction and blowing integrated nozzle 120. Then, the liquid and the air introduced into the suction portion 121 may flow into the suction portion 111*b* of the second main body 110*b*.

First, flow of the liquid will be described. The liquid that has flowed into the suction portion 111*b* may collide with the partition portion 112*b* and then flow down the partition portion 111*b*. The liquid may be introduced into the drain tank 130 through the liquid discharge portion 114*b*. That is, the flow path of the liquid extends from the suction portion 121 of the suction and blowing integrated nozzle 120 to the suction portion 111*b* of the second main body 110*b*, and then to the partition portion 112*b* to the liquid discharge portion 114*b* to the drain tank 130 as indicated by a leftward dotted line in FIG. 7.

Next, the air flow will be described. The air that has flowed into the suction portion 111*b* may collide with or may be guided by the partition portion 112*b* and may be then introduced into the suction duct 142 of the suction motor unit 140 through the air discharge portion 113*b*. Any air initially flowing toward the liquid discharge portion 114*b* rather than toward the air discharge portion 113*b* at the suction portion 111*b* may then flow toward the air discharge portion 113*b* through the air flow chamber 115*b* formed at the backside of the suction portion 111*b* and may be then introduced into the suction duct 142. The air introduced into the suction duct 142 may be discharged from the first main body 110*a* via an outlet (now shown). In other words, as indicated by an alternated long and short dash line in FIG. 7, the flow path of the air the flow path of the liquid extends from the suction portion 121 of the suction and blowing integrated nozzle 120 to the suction portion 111*b* of the second main body 110*b* to the partition portion 112*b* to the air discharge portion 113*b* to the suction motor unit 140.

Figure 8:
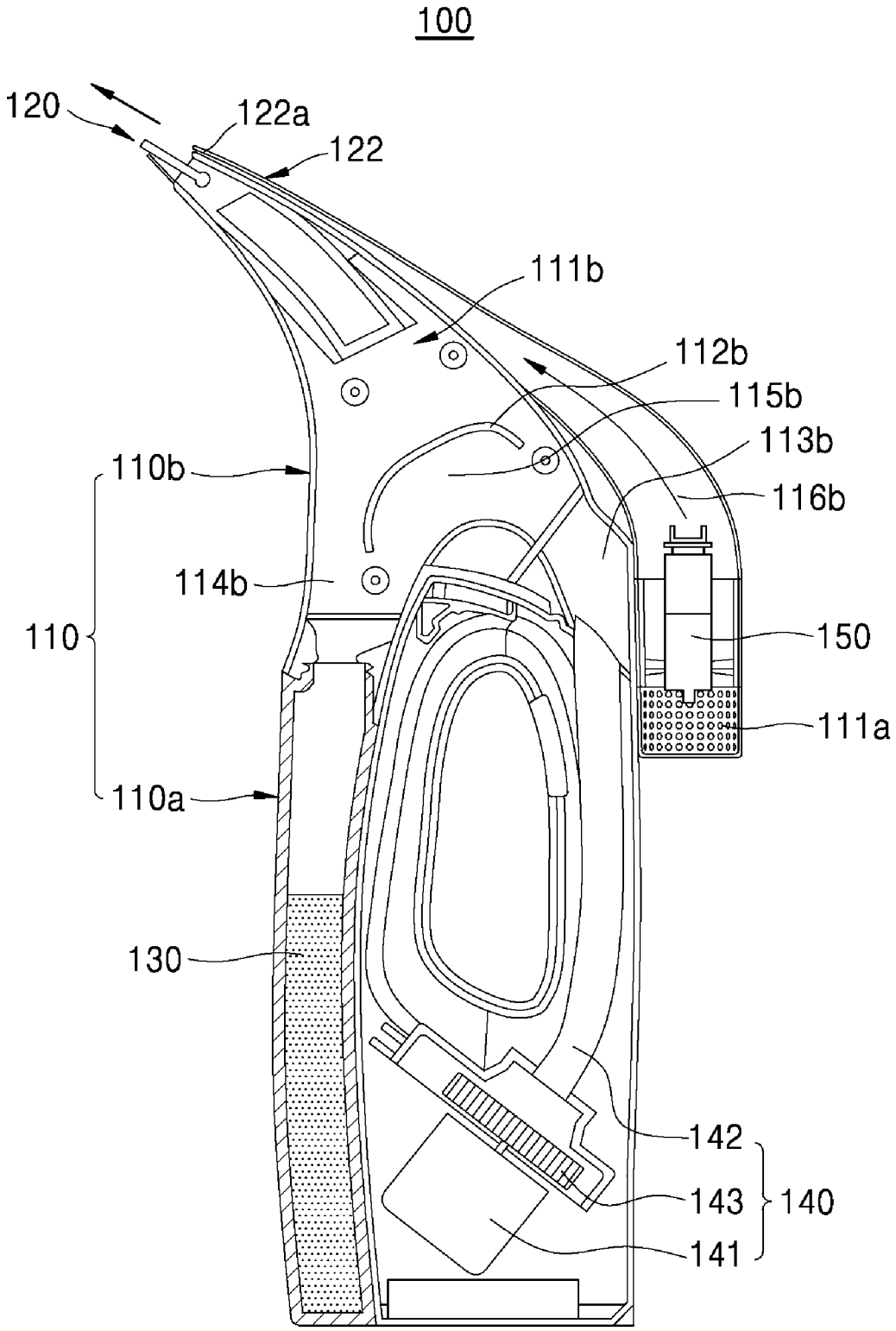
FIG. 8 is a schematic view illustrating operation in an air blowing mode of the remaining water suction device shown in FIG. 3.

FIG. 8 is a schematic view illustrating operation in an air blowing mode of the remaining water suction device 100 shown in FIG. 3. When the user selects the air blowing mode, the blowing motor 150 may be operated. The air blown by the blowing motor 150 flows to the blowing portion 122 of the suction and blowing integrated nozzle 120 via the blowing duct 116*b* of the second main body 110*b* and may be then discharged to the outside via the penetrated portion 122*a*. The blown air may be pressurized while passing through the blowing duct 116*b* and the penetrated portion 122*a* of the blowing portion 122, due to the gradually reduced cross-sectional area of the penetrated portion 122*a*, such that the air can be jetted from the penetrated portion 122*a* in a pressurized state. That is, as indicated by a dotted line in FIG. 8, the flow path of the air blown by the blowing motor 150 extends from the blowing duct 116*b* to the penetrated portion 122*a* of the blowing portion.

As described above, according to the first embodiment of the present disclosure, in the remaining water suction device 100 having the air blowing function, the remaining water suction mode and the air blowing mode can be selectively activated according to an input or other control operation by the user.

Figure 9:
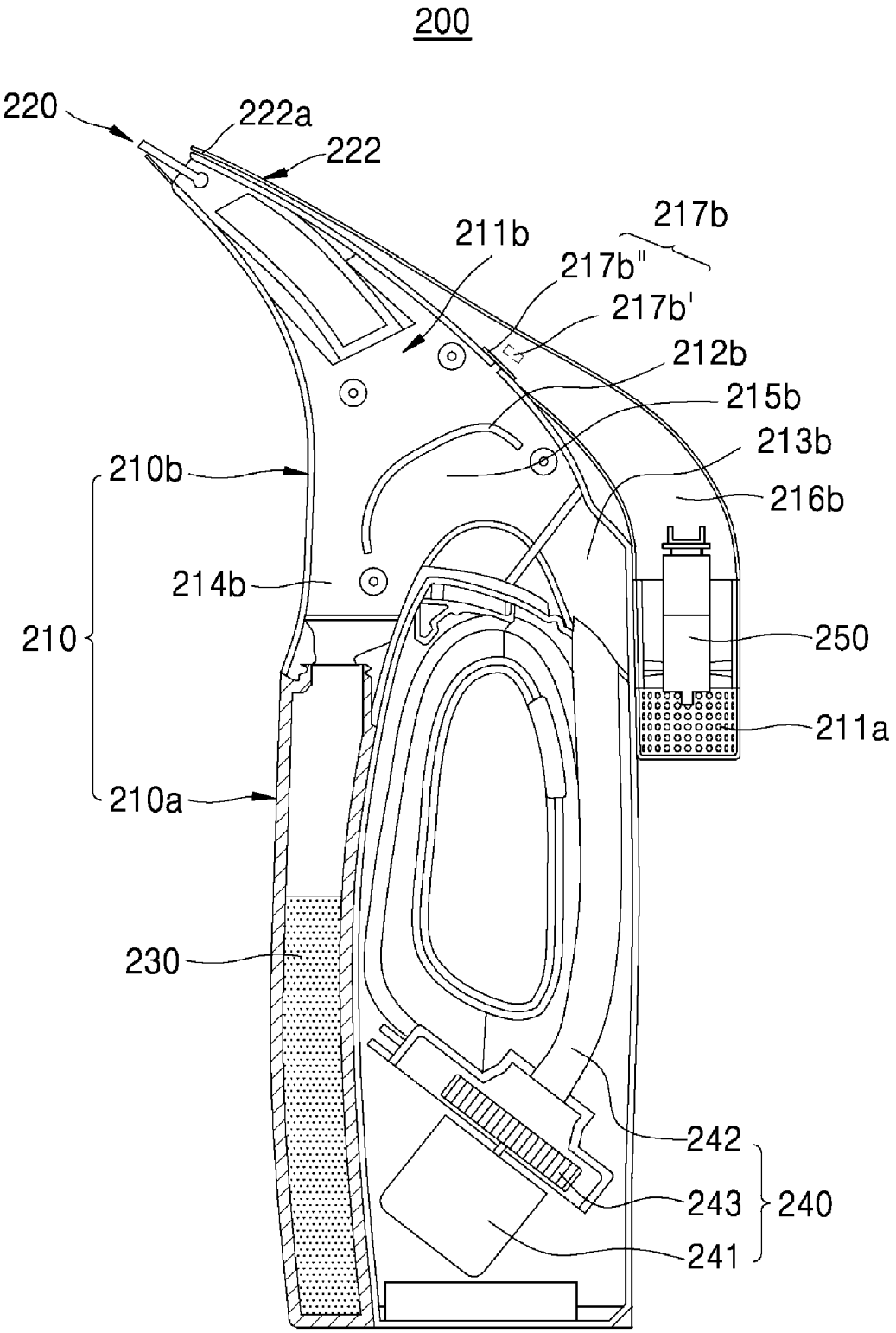
FIG. 9 is a schematic view illustrating a configuration of a remaining water suction device having an air blowing function according to a second embodiment of the present disclosure.
Figure 10:
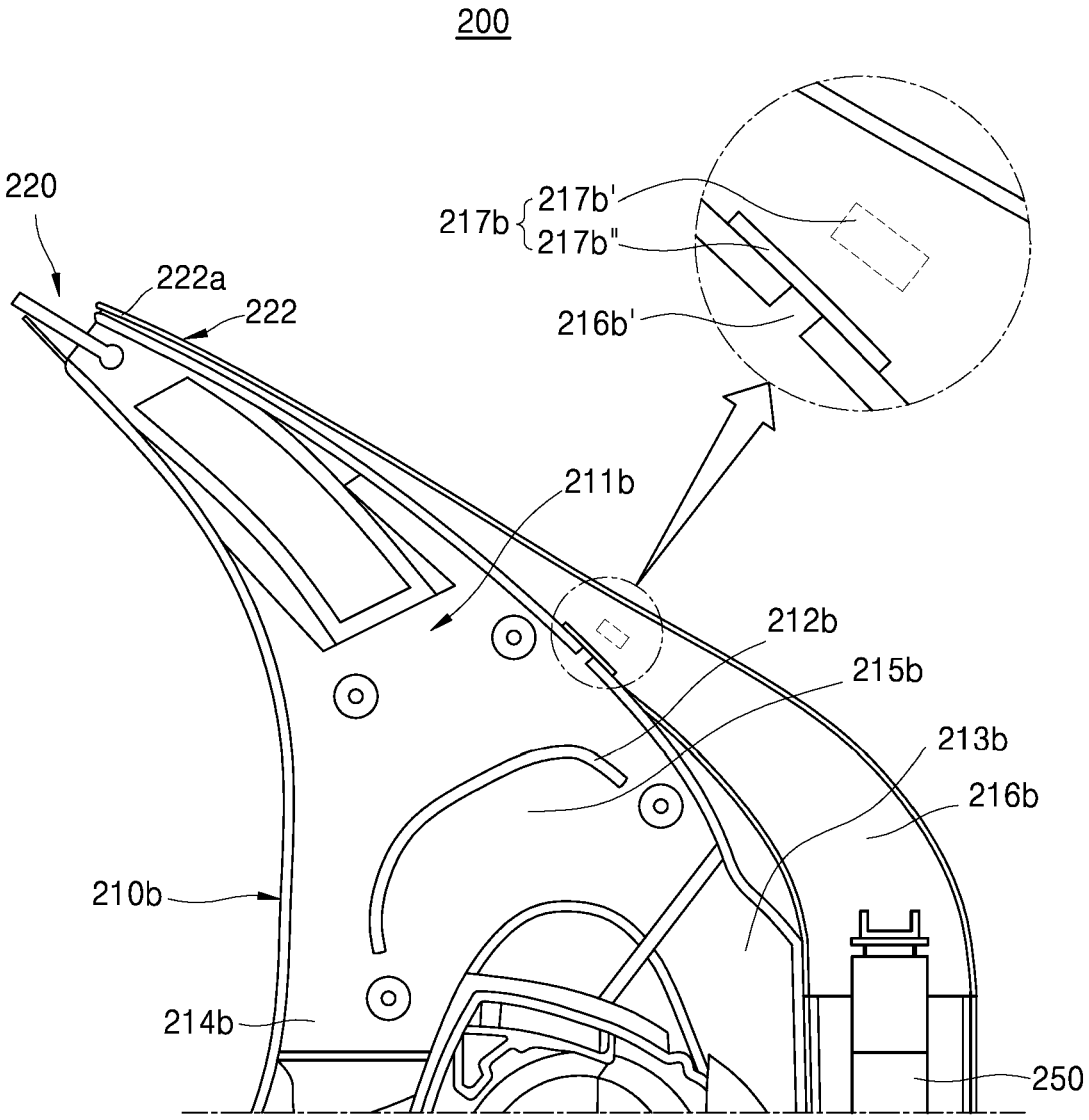
FIG. 10 is a schematic cross-sectional view of a fluid flow guide body in the remaining water suction device shown in FIG. 9.

FIG. 9 is a schematic view illustrating a configuration of a remaining water suction device 200 having an air blowing function according to a second embodiment of the present disclosure, and FIG. 10 is a schematic cross-sectional view of a fluid flow guide body in the remaining water suction device shown in FIG. 9. As shown in FIGS. 9 and 10, a difference between the remaining water suction device 200 according to the second embodiment and the remaining water suction device 100 according to the first embodiment shown in FIG. 2 includes a configuration of the second main body 210*a* and the blower motor 250.

More specifically, the remaining water suction device 200 may include first and second main bodies 210*a* and 210*b*, a suction and blowing integrated nozzle 220, a drain tank 230, a suction motor unit 240, and a blowing motor 250. As described above, the first main body 210*a*, the suction and blowing integrated nozzle 220, the drain tank 230, and the suction motor unit 240 may be similar to the corresponding elements of the remaining water suction device 100 in the first embodiment depicted in FIG. 3, and thus a detailed description thereof will be omitted.

In addition to blowing air out of the suction and blowing integrated nozzle 220, the remaining water suction device 200 according to the second embodiment of the present disclosure may selectively jet air blown by the air blowing motor 250 toward the liquid discharge portion 214*b*. This functionality may help to prevent the liquid suctioned through the suction and blowing integrated nozzle 220 from flowing into the suction motor unit 240 and to further improve suction efficiency.

To this end, the second main body 210*b*, which may be a fluid guide body that may function to guide air and liquids sucked in through the suction and blowing integrated nozzle 220, may include a suction portion 211*b*, a partition portion 212*b*, an air discharge portion 213*b*, a liquid discharge portion 214*b*, an air flow chamber 215*b*, and a blowing duct 216*b*.

The blowing duct 216*b* may be arranged to face the blowing motor 250 mounted on the first main body 210*a*. In the second embodiment depicted in FIG. 9, the blowing duct 216*b* may be provided with a through hole 216*b*' facing the front part (or surface) of the partition portion 212*b*, that is, an area between the suction portion 211*b* and the partition portion 212*b*.

As described below, the through hole 216*b*' may be provided to selectively jet the air blown by the blowing motor 250 toward the liquid discharge portion 214*b*. For example, in order to selectively open and close the through hole 216*b*', an opening/closing control lever unit 217*b* may be mounted on the second main body 210*b*. For example, when suctioning the remaining water through the suction and blowing integrated nozzle 220, air should not be jetted through the suction and blowing integrated nozzle. Therefore, the air blown by the blowing motor 250 may not flow to the blowing portion 222 of the suction and blowing integrated nozzle 220 but may flow toward the liquid discharge portion 114*b* through the through hole 216*b*' when the suction motor unit 240 is activated.

Figure 11:
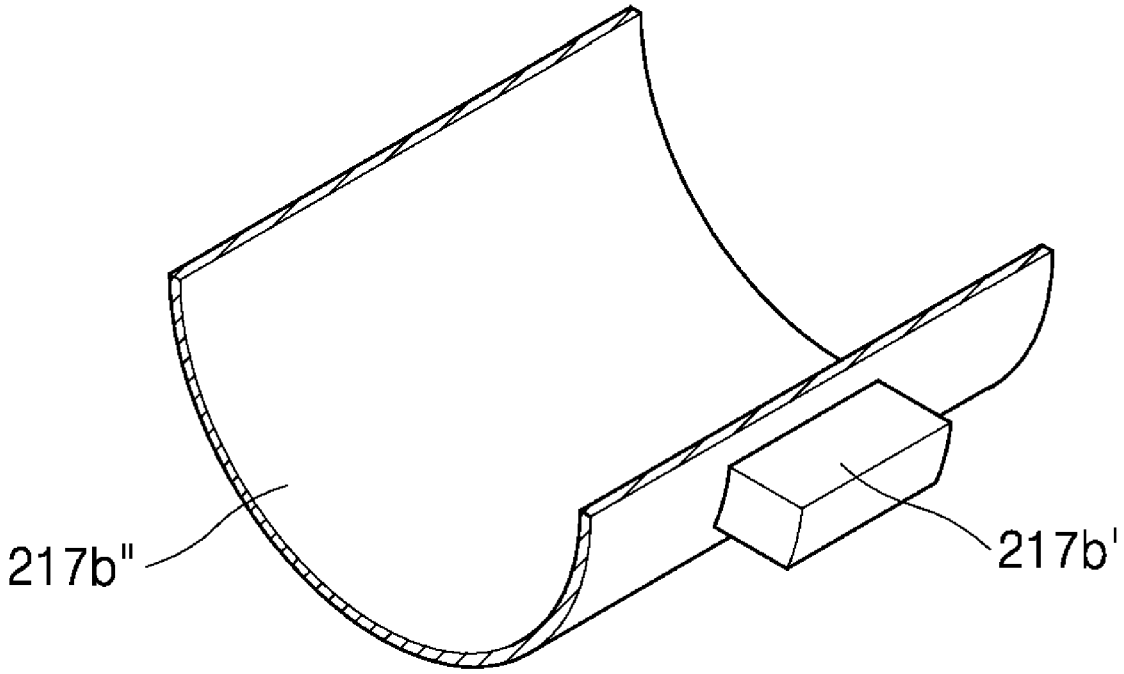
FIG. 11 is a perspective view schematically showing an opening/closing control lever unit shown in FIG. 10.

To implement this configuration, the opening/closing control lever unit may be adopted in various ways. FIGS. 10 and 11 illustrate an example of an opening/closing control lever unit 217*b* that may include a lever 217*b*' and a blocking plate 217*b*" as an embodiment. More specifically, the lever 217*b*' may be exposed to the outside of the second main body 210*b* (e.g., through an opening in the second main body 210*b*) and may be coupled to one side or both sides of the blocking plate 217*b*". The blocking plate 217*b*" may be moved by operation of the lever 217*b*'.

The blocking plate 217*b*" may be located inside the blowing duct 216*b* and may be provided to cover the through hole 216*b*'. The blocking plate 217*b*" may be mounted on the second main body so as to be rotatable or otherwise movable from the through hole 216*b*' by operation of the lever 217*b*'. The blocking plate 217*b*" may be formed as a plate from of an elastic material (or other material) to selectively open and close the through hole 216*b*' while moving inside the blowing duct 216*b*. For example, the blocking plate 217*b*" may be hingedly connected within the blowing duct 216*b* such that the blocking plate 217*b*" can be flipped, rotated, or otherwise moved between a first position that blocks the through hole 216*b*' but does not impede the blowing duct 216*b* to a second position that exposes the through hole 216*b*' and blocks the blowing duct 216*b*. In another example, the blocking plate 217*b*" correspond to a baffle that directs air flow from the blowing motor 250 to one of the blowing duct 216*b* or the through hole 216". In yet another example, the blocking plate 217*b*" may direct a first portion of the air flow from the blowing motor 250 to the blowing duct 216*b* and a second portion of the air flow from the blowing motor 250 to or the through hole 216".

The air blowing motor 250 may have an adjustable air flow speed. For example, the air blowing motor 250 may provide air at a relatively high air flow speed (or ranges of air flow speeds) in the air blowing mode (e.g., when the blocking plate 217*b*" blocks the through hole 216*b*') such that high velocity (or high pressure) air is directed through the blowing portion 222 of the suction and blowing integrated nozzle 220). However, when air from the air blowing motor 250 is directed through the through hole 216*b*' (e.g., when the blocking plate 217*b*" is moved to expose the through hole 216*b*'), the air may be provided by the air blowing motor 250 at a lower air flow speed (or lower air pressure) than in the air blowing mode. The air flow speed in the blowing motor 250 may be adjusting using a conventional technology that may be easily implemented by those skilled in the art, and thus a detailed description thereof will be omitted. For example, the air flow speed from the blowing motor 250 may be adjusted by modifying a current and/or voltage driving the blowing motor 250 and/or by selectively positioning one or more other components (e.g., a blocking surface) one or more of an inlet or an outlet of the blowing motor 250.

The remaining water suction device 200 according to the second embodiment of the present disclosure may be configured as described above to provide the air blowing function. Hereinafter, the respective technical implementation processes of the remaining water suction and air blowing will be described in more detail with reference to FIGS. 11 and 12.

Figure 12:
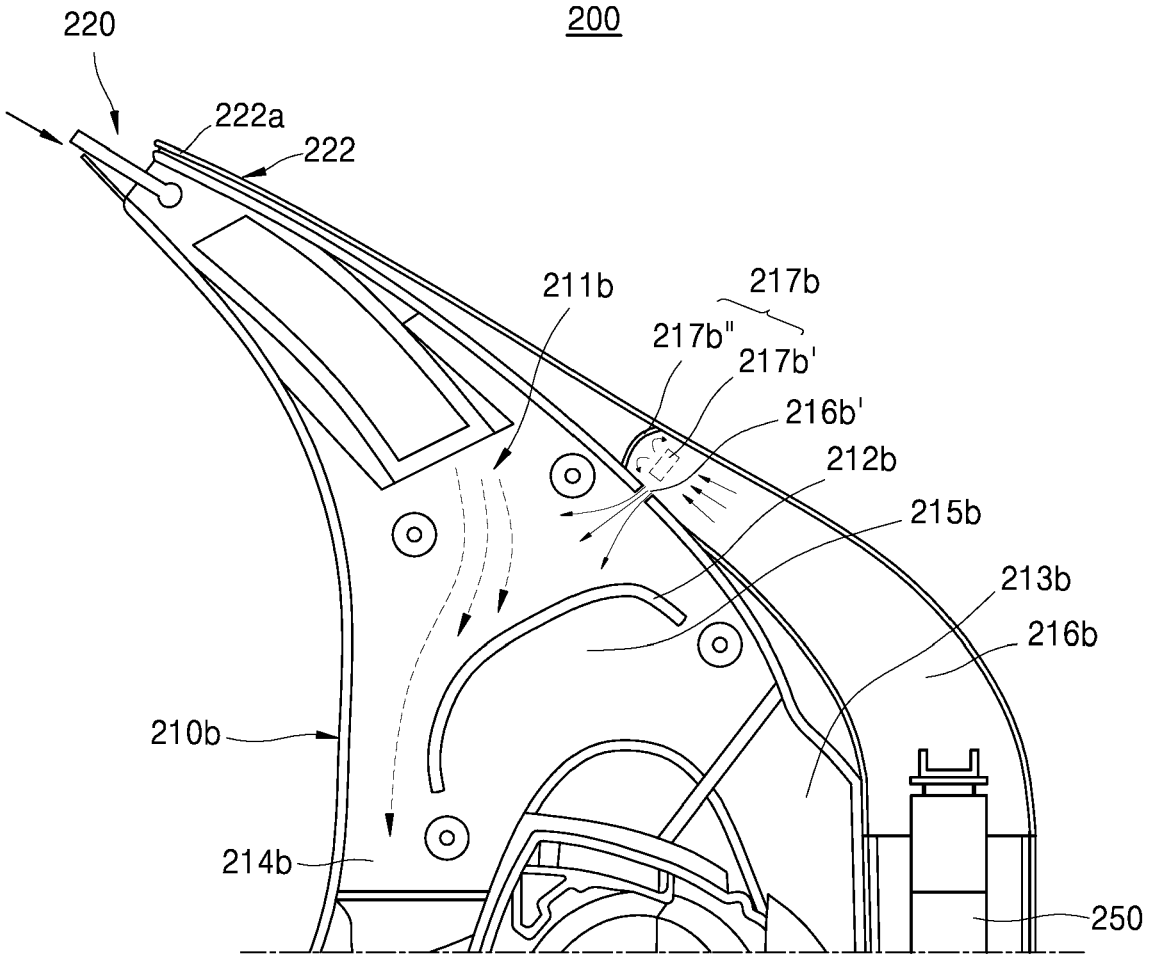
FIG. 12 is a schematic view illustrating an operation in a remaining water absorption mode of the remaining water suction device shown in FIG. 9.

FIG. 12 is a schematic view illustrating an operation in a remaining water absorption mode of the remaining water suction device 200 shown in FIG. 9. For example, when a liquid (e.g., remaining water) is to be suctioned through the suction and blowing integrated nozzle 220, the user may use or otherwise activate the lever 217*b*' to move the blocking plate 217*b*" to open the through hole 216*b*' and close the side of the blowing duct 216*b* connected to the penetrated portion 222*a* of the suction and blowing integrated nozzle 220. For example, the blocking plate 217*b*" may be rotatably mounted within the blowing duct 216*b* such that the blocking plate 217*b*" may by moved by the lever 217*b*' between a first position blocking the through hole 216*b*' while exposing the blowing duct 216*b* and a second position exposing the through hole 216*b*' while blocking the blowing duct 216*b*.

When the remaining water absorption mode is selected, the suction motor 241 may be operated to drive the suction fan 243, and the remaining water and air may be introduced into (i.e., sucked through) the suction portion 221 of the suction and blowing integrated nozzle 220 by a suction force generated by the suction fan 243. The liquid and the air introduced through the suction portion 221 may flow to the suction portion 211*b* of the second main body 210*b*.

When the blowing motor 250 is operated and the liquid flowing into the suction portion 211*b* collides with the partition portion 212*b*, the air blown by the blowing motor 250 may be jetted toward the liquid discharge portion 214*b* through the through hole 216*b*'. As a result of the air flow though the through hole 216*b*', the liquid present in the suction portion 211*b* may be guided to the liquid discharge portion 214*b* at the partition portion 212*b* and may, thus, be prevented from flowing to the suction motor unit 240. That is, air flow through the through hole 216*b*' may forcibly guide the flow of the liquid toward the liquid discharging portion 214*b* and away from the air discharge portion 213*b*. As previously described, the liquid in the liquid discharging portion 214*b* may be introduced into the drain tank 230, and the air flow in the air discharge portion 213*b* may be introduced into the suction duct 242 of the suction motor unit 240 through the air flow chamber 215*b* and may be discharged to an outside of the remaining water suction device 200.

Figure 13:
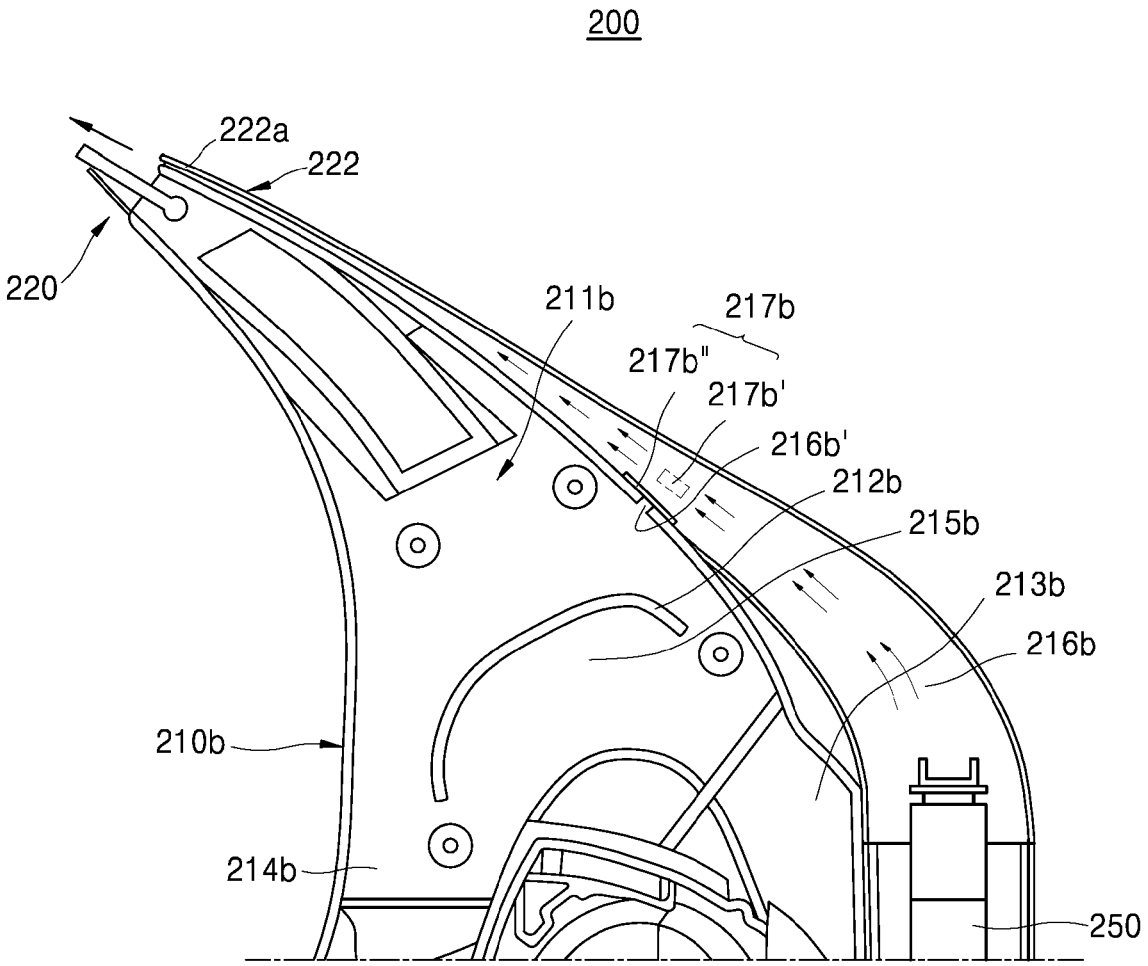
FIG. 13 is a schematic view illustrating operation in an air blowing mode of the remaining water suction device shown in FIG. 9.

FIG. 13 is a schematic view illustrating operation in an air blowing mode of the remaining water suction device shown in FIG. 9. In the an air blowing mode, the user may use the lever 217*b*' to move the blocking plate 217*b*" to close the through hole 216*b*' and open the side of the blowing duct 116*b* connected to the penetrated portion 222*a* of the suction and blowing integrated nozzle 220. In another example, the lever 217*b*' may be automatically moved (e.g., without an input from the user) when the blowing motor 250 is activated while the suction motor unit 240 is inactivate. For example, the lever 217*b* may be selectively driven by an actuating motor (not shown) based on the status of at least one of the suction motor unit 240 or the blowing motor 250.

When the air blowing mode is selected, the air blown by the blowing motor 250 may flow into the blowing duct 216*b* of the second main body 210*b*, and may be jetted outward through the blowing portion 222 of the suction and blowing integrated nozzle 220. In the air blowing mode, the through hole 216*b*' may be closed and the blowing duct 216*b* is not impeded by the blocking plate 217*b*" such air from the blowing motor 250 can be jetted outward through the suction and blowing integrated nozzle 220 without loss.

Consequently, in the remaining water suction device 200 having the air blowing function according to the second embodiment configured as above, when the remaining water is suctioned, the flow direction of the air blown by the blowing motor may be selectively manipulated to be internally directed toward a flow of suctioned liquid to prevent the suctioned liquid from flowing into the suction motor. Therefore, the redirected air flow can help prevent the suction motor unit 240 from being damaged due to introduction of the suctioned liquid.

The present disclosure may provide a remaining water suction device having an air blowing function which is capable of effectively removing water from a wall surface by separating remaining water stuck to the wall surface from the wall surface by blowing air to the remaining water. The present disclosure may also provide a remaining water suction device having an air blowing function which is capable of effectively removing remaining water sporadically distributed on the floor by collecting the remaining water at one place and suctioning the collected remaining water at one time.

The present disclosure may further provide a remaining water suction device having an air blowing function which is capable of effectively removing remaining water by jetting air onto the remaining water near a drain hole and discharging the remaining water through the drain hole. The present disclosure may additionally provide a remaining water suction device having an air blowing function which can eliminate a risk of damaging a suction motor in suctioning remaining water by jetting air to guide the suctioned liquid to a drain tank rather than to the suction motor and thus can be used safely for a long time.

The present disclosure may include an air blowing module and a suction and blowing integrated nozzle. That is, in the present disclosure, air flow may be generated through the air blowing module, and the air flow may be sprayed to the wall surface through the suction and blowing integrated nozzle. Thereby, the remaining water may be effectively removed from the wall surface. Accordingly, bacteria and fungi may be prevented from growing due to the remaining water to create an unsanitary condition or corrode the wall surface.

As described above, the conventional remaining water suction device cannot effectively remove remaining water which may be not gathered at one place but may be scattered sporadically on the floor surface. To address this concern, a remaining water suction device according to the present disclosure may include a suction and blowing integrated nozzle, a suction motor unit, a drain tank, and an air blowing module. Specifically, in the remaining water suction device according to the present disclosure, air flow may be generated through the air blowing module and jetted onto the sporadically scattered remaining water through the suction and blowing integrated nozzle, thereby collecting the remaining water at one place. Further, the collected remaining water may be suctioned at once and stored in the drain tank using the suction motor and the suction and blowing integrated nozzle. Thus, the scattered remaining water may be effectively removed, thereby addressing the problem of incomplete suctioning of the remaining water.

In addition, as described above, in the case of the conventional remaining water suction device, even the remaining water near the drain hole of the bathroom or toilet must be suctioned and removed. To address this issue, the remaining water suction device according to the present disclosure may include an air blowing module and a suction and blowing integrated nozzle. More specifically, in the present disclosure, air flow may be generated through the air blowing module and jetted onto the remaining water near the drain hole through the suction and blowing integrated nozzle such that the remaining water may be moved to and discharged through the drain hole. Thus, the remaining water suction device according to the present disclosure may neatly remove the remaining water near the drain hole without separate suctioning of the remaining water.

Further, as described above, according to the conventional remaining water suction device, when the suctioned liquid may be introduced into the suction motor, there may be a risk of damaging the suction motor. To address this issue, the remaining water suction device according to the present disclosure may include an opening/closing control lever unit for selectively directing the air flow generated from the blowing motor toward the suction and blowing integrated nozzle or the main body.

That is, in the present disclosure, when the remaining water is suctioned, the air blowing duct directed to the suction and blowing integrated nozzle may be blocked, and the air flow generated from the blowing motor may be jetted toward the drain tank through a through hole. Therefore, the internal air flow may direct the suctioned liquid away from the suction motor and may prevented the suctioned liquid from flowing into the suction motor such that a service life of the product may be enhanced.

According to the present disclosure, the user can select a remaining water suction mode or an air blowing mode according to, for example, the type and state of remaining water. Thus, remaining water may be more effectively removed. In other words, remaining water stuck to the surface of a wall, which can be removed by suctioning, may be removed from the surface of the wall by selecting the air blowing mode according to the condition of the wall surface or the degree of distribution of the remaining water and jetting air onto the remaining water. Conversely, if the remaining water scattered sporadically in a large area of a wall surface or out of a reach of the user (e.g., on a ceiling surface), it takes a long time to remove the remaining water using a suctioning function, whereas an outward air flow function may allow the distributed remaining water to be removed in a relatively short time.

In addition, the present disclosure may eliminate the need for laborious suctioning of remaining water scattered sporadically around the bathroom floor and shorten the time needed to remove the remaining water by jetting air onto the remaining water to collect the remaining water at one place and suction the collected remaining water at once. Further, as the air is blown, a bathroom floor or other surface may be quickly dried. Further, according to the present disclosure, by jetting air to discharge the remaining water near the drain hole through the drain hole without suctioning the remaining water, the remaining water may be effectively removed through the drain hole, and the work time for removing the remaining water may also be shortened.

According to the present disclosure, when the remaining water is suctioned, an air flow may be used to prevent the suctioned liquid from flowing into the suction motor by selectively adjusting the flow direction of the air flow generated from the air blowing motor. Therefore, the suction motor may be protected from damages caused by an introduced liquid. Further, the adjustable air flow may avoid a need for installation of a separate filter for blocking introduction of the liquid into the suction motor. Therefore, manufacturing costs may be reduced.

It is to be understood that the above-described embodiments may be to be considered in all respects as illustrative and not restrictive, and the scope of the disclosure should be defined by the appended claims rather than by the foregoing description. It is intended that all changes and modifications that come within the meaning and range of equivalency of the claims, as well as any equivalents thereof, be within the scope of the present disclosure.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A remaining water suction device having an air blowing function, comprising:

a nozzle;

a suction motor that drives a suction fan to provide a suction force to suction liquid and air into the nozzle;

a drain tank that stores the suctioned liquid received through the nozzle;

a blowing motor that blows air to the nozzle;

a main body having the nozzle, the suction motor, the drain tank, and the blowing motor mounted thereto; and a blocking plate that is moved to selectively switch a flow direction of the air blown from the blowing motor toward the nozzle or toward a flow path of the suctioned liquid within the main body, wherein the main body further includes:

a suction chamber that receives the suctioned liquid and air from the nozzle;

a liquid discharge path formed to face the drain tank;

a partition plate having a first surface facing the suction chamber and provided to be inclined downward toward the liquid discharge path;

an air discharge path formed to face the suction motor;

a blowing duct formed to face the blowing motor; and a through hole provided between the suction chamber and the blowing duct, wherein the blocking plate is movable to selectively open one of the through hole or the blowing duct connected to the nozzle, and to selectively close another one of the through hole or the blowing duct, and wherein the through hole is positioned to face the first surface of the partition plate such that when the blocking plate is positioned to at least partially open the through hole and to at least partially block the blowing duct, the air blown from the blowing motor passes via the through hole and into the suction chamber to blow the suctioned liquid toward the partition plate to be guided toward the drain tank and away from the air discharge path.

2. The remaining water suction device according to claim 1, wherein the main body includes:

a first main body having the suction motor and the blowing motor mounted therein and the drain tank detachably coupled thereto; and a second main body having an end coupled to the first main body and an opposite end coupled to the nozzle, the second main body being configured to guide the suctioned liquid water and air from the nozzle and the blown air toward the nozzle, wherein the blocking plate is mounted to the second main body.

3. The remaining water suction device according to claim 2, wherein the second main body includes:

the suction chamber;

the liquid discharge path;

the partition plate;

the air discharge path; and the blowing duct.

4. The remaining water suction device according to claim 3, further comprising:

a lever exposed to an outside of the second main body, wherein the blocking plate is connected to the lever and is moved by operation of the lever between a first position directing the blown air through the blowing duct and a second position directing the blown air through the through hole.

5. The remaining water suction device according to claim 1, wherein the blocking plate is formed of an elastic material.

6. The remaining water suction device according to claim 1, wherein the blowing motor outputs the blown air at a first air velocity when the blocking plate directs the blown air toward the nozzle, and at a second air velocity that is lower than the first velocity when the blocking plate directs the blown air toward the flow path of the suctioned liquid within the main body.

* * * * *